US006523208B1

(12) United States Patent
Muscato et al.

(10) Patent No.: US 6,523,208 B1
(45) Date of Patent: Feb. 25, 2003

(54) FLEXIBLE WEB CLEANING SYSTEM

(75) Inventors: Mark Muscato, Webster, NY (US); Carl A. Wisniewski, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/534,232

(22) Filed: Mar. 24, 2000

(51) Int. Cl.[7] ..... B08B 1/02

(52) U.S. Cl. ..... 15/3; 15/256.53; 15/256.51; 15/102

(58) Field of Search ..... 15/3, 100, 102, 15/256.5, 256.51, 256.53; 118/203

(56) References Cited

U.S. PATENT DOCUMENTS

| | | | | |
|---|---|---|---|---|
| 1,701,639 A | * | 2/1929 | Schulz | 15/100 |
| 2,791,788 A | * | 5/1957 | Hausdorf | 15/100 |
| 5,251,348 A | | 10/1993 | Corrado et al. | 15/256.53 |
| 5,264,249 A | * | 11/1993 | Perrault et al. | 427/327 |
| 5,275,104 A | | 1/1994 | Corrado et al. | 101/425 |
| 5,423,104 A | * | 6/1995 | West | 15/100 |
| 5,685,043 A | | 11/1997 | LaManna et al. | 15/256.52 |
| 5,699,584 A | | 12/1997 | Wieloch et al. | 15/256.52 |
| 5,855,037 A | | 1/1999 | Wieloch et al. | 15/256.5 |
| 5,964,007 A | | 10/1999 | Wisniewski et al. | 15/256.53 |
| 6,162,303 A | | 12/2000 | Wieloch et al. | 134/6 |
| 6,401,287 B1 | * | 6/2002 | Corrado et al. | 15/3 |

FOREIGN PATENT DOCUMENTS

EP 0 756 215 A2 1/1997

* cited by examiner

*Primary Examiner*—Gary K. Graham
(74) *Attorney, Agent, or Firm*—Annette L. Bade

(57) ABSTRACT

A web cleaning system including a stationary frame and a rotatable frame being rotatable about an axis while supported by the stationary frame. The rotatable frame supporting first and second contact cleaning rolls that are rotatable about axes and are spaced from and parallel to each other and the axis of the rotatable frame. A web transport device is disposed to fed a web along a predetermined path between the first and second contact cleaning rolls. Major surfaces of the web being parallel to the axes of the cleaning rolls when fed therebetween.

12 Claims, 6 Drawing Sheets

FLEXIBLE WEB CLEANING SYSTEM

BACKGROUND OF THE INVENTION

This invention relates in general to a web cleaning system and more specifically, to an apparatus and process for cleaning flexible webs.

In the art of electrophotography an electrophotographic member comprising a photoconductive insulating layer on a conductive layer is imaged by first uniformly electrostatically charging the imaging surface of the photoconductive insulating layer. The member is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic member is often in the form of a flexible multilayered photoreceptor belt comprising a substrate, a conductive layer, an optional hole blocking layer, an optional adhesive layer, a charge generating layer, and a charge transport layer and, in some embodiments, an anti-curl backing layer.

Although excellent toner images may be obtained with multilayered belt photoreceptors, it has been found that as more advanced, higher speed electrophotographic copiers, duplicators and printers were developed, the electrical and mechanical performance requirements have become more demanding. Moreover, new digital color products could not tolerate coating defects at the size levels previously found acceptable for light lens copiers. It has also been found that these electrical and mechanical performance requirements were not being met because of defects in one or more of the coated layers of the multilayered belt photoreceptors. These defects are caused by the presence of dirt particles on the substrate, conductive layer, optional hole blocking layer, optional adhesive layer, charge generating layer, charge transport layer and/or optional anti-curl backing layer. Thus for example, particles of dirt (particulate debris) residing on an uncoated or coated substrate surface during application of coatings to form an electrostatographic imaging member, such as a photoreceptor, can cause bubbles or voids to form in the various applied coating layers. It is believed that the dirt particles behave in a manner similar to a boiling chip that initiates solvent boiling at the location of the particle. This local boiling problem is aggravated when a coating solution is maintained near the boiling point of the coating solvent during deposition of the coating or during drying. The formation of bubbles in a coating is particularly acute in photoreceptor charge generation layer coatings and in charge transport layer coatings. Also, dirt particles tend to trap air during application of a coating and the trapped air expands during drying to form an undesirable bubble in the coating.

Further, any dirt particles residing on one or both major surfaces of an electrophotographic imaging member web substrate or coating thereon can adversely affect adjacent surfaces when the web is rolled up into a roll because the dirt particles cause impressions on the adjacent web surfaces. Because these undesirable impressions can be repeated through more than one overlapping web layer, large sections of a coated web must be scrapped. Where large belts, e.g. ten pitch belts, are to be fabricated, a 10 percent defect rate for a single pitch can result in the discarding of 60 to 70 percent of the entire web because very large expanses of defect free surfaces are required for such large belts.

The sources of the dirt particles include transporting systems, coating systems, drying systems, cooling systems, slitting systems, winding systems, unwinding systems, debris from the electrophotographic imaging member web substrate itself, workers, and the like.

In relatively thin charge blocking layers, such as organopolysiloxane layers applied with a gravure coater, any dirt particles present on the web surface tends to lift the coating layer and cause local coating voids. This also occurs with relatively thin adhesive layers between a charge blocking layer and a charge generation layer. Usually, after a web substrate is coated with the charge blocking layer and adhesive layer, the coated web substrate is rolled up into a roll and transported to another coating station. During unrolling or unwinding of the coated web, static electricity is generated as the outermost ply of the coated web is separated from the roll. This static electricity tends to attract dirt particles to the exposed surfaces of the web.

It has been found that brushing, buffing or other cleaning systems which physically contact the delicate and fragile surfaces of a coated or uncoated electrophotographic imaging member web substrate can cause undesirable scratches in the delicate outer surface of the substrate even if the contact systems are employed in conjunction with electrostatic discharge bars. Cleaning systems that do not contact the coated or uncoated electrophotographic imaging member web substrate, such as air knives and vacuum systems, whether or not assisted with electrostatic discharge bars, are not capable of removing small particles, those having an average particle size of less than about 100 micrometers to 30 micrometers range due to electrostatic attraction and a thin protective inertial air boundary layer on the substrate surface.

The use of a contact cleaner roll making continuous rolling contact with a moving web can remove loose particles of contamination from the web, if the outer surface of the roll has a tacky outer surface. As the web moves over the cleaner roll, the loose particulate matter is transferred from the web to the contact cleaner roll. As this transfer process continues, the transferred contaminants accumulate on the surface of the cleaner roll. The cleaner roll itself eventually becomes contaminated and looses its effectiveness to the point where it can redeposit undesirable particles on a web during the cleaning operation. Thus, the cleaner roll is replaced or cleaned periodically to restore its effectiveness. This is typically accomplished by shutting down the system or process, retracting the cleaner roll, and washing and drying it manually. Attempts to clean these rolls by hand encountered difficulties because the rolls were normally in inaccessible locations. Further, cleaning of the entire outer periphery of a contact cleaning roll required scrubbing of the entire outer peripheral of the contact cleaning roll with cleaning material. Since contact cleaning rolls are mechanically driven, these rolls could not be easily rotated for cleaning unless they are separated from the driving device or removed entirely from the cleaning module. To avoid down time of the system or process, these contact cleaner rolls can be cleaned without interrupting the continuous movement of web through the apparatus by a device for sequential cleaning of the contact cleaner rolls. This type of contact cleaner roll system is disclosed, for example, in U.S. Pat. No. 5,251,348, the disclosure thereof being incorporated herein in its entirety.

When a web coating system utilizes contact cleaning rolls for cleaning a web of one type carrying durable strongly adhering coatings, the same coating system can not be utilized for processing other types of coating operations where the web contains delicate, poorly adhering coatings because the contact cleaning rolls can damage or even remove the delicate coating. Thus, for those webs having delicate coatings, the contact cleaning rolls must be removed to allow the web to pass. Further, removal of such contact cleaning rolls also requires that any web to be coated with a delicate coating must be threaded through the entire coating system rather than merely being tacked onto the end of a previous web and automatically fed around the various idler rolls and drive rolls and coating applying and drying stations. Since a typical production coating utilizes many idler rolls, threading of a web through the system is not a simple task.

The space around coating applicators often has a high solvent content. This is because the solvent in the applied coating mixture is volatile to facilitate drying of the deposited coating. Since most volatile solvents used for coating are also flammable, the regions near coater devices can be explosive. Contact cleaning rolls normally occupy a large volume of space and therefore require extensive floor space. Because electric drive systems are conventionally used to operate the contact cleaning rolls, safety requirements dictated that the cleaning rolls be located outside of coating stations utilizing flammable solvents. This separation between the cleaning rolls and the coating stations increased the likelihood that undesirable contaminates would deposit on the substrate to be coated in the separation space between the cleaning station and the coating station. Such arrangements also increased the footprint of coating systems.

INFORMATION DISCLOSURE STATEMENT

U.S. Pat. No. 5,855,037 to Wieloch et al., issued Jan. 5, 1999—A contact cleaner roll cleaning system is disclosed including a frame to support the system relative to a movable web having a first major surface and a second major surface on opposite sides of the web, at least a first rotatable contact cleaner roll supported on the frame disposed for rolling contact with the first major surface, an activatable web transporting device adapted to transport or interrupt the transport of the web past the first rotatable contact cleaner roll, and a first indexing device adapted to roll the first rotatable contact cleaner roll against the first major surface in a first direction while the transport of the web past the first rotatable contact cleaner roll is interrupted This system is used to clean coated and uncoated webs.

U.S. Pat. No. 5,685,043 to LaManna et al., issued Nov. 11, 1997—A system is disclosed in which a contact cleaning cylinder is brought into moving synchronous contact with the surface of a cylindrical member to be cleaned to clean the surface.

U.S. Pat. No. 5,251,348 to Corrado et al, issued Oct. 12, 1993—A contact cleaner roll cleaning system is described which includes a frame supporting the system relative to a moving web, a contact cleaner roll turret on the frame, and a roll cleaner on the frame. The turret supports two or more rotatable contact cleaner rolls, an active roll in rolling contact with the web, and an idle roll out of contact with the web for cleaning. The idle roll is kept rotating while it is idle and being cleaned. The turret is rotatable to sequentially put the cleaner rolls into and out of contact with the web. The roll cleaner includes an absorbent cleaning material mounted adjacent to the idle roll for placement against it and movement lengthwise along it to wipe it clean. Spindles advance the cleaning material between wipings of the idle roll, and a liquid delivery system keeps the cleaning material wet.

U.S. Pat. No. 5,275,104 to Corrado et al, issued Jan. 4, 1994—Apparatus is disclosed for cleaning a rotating process roll includes cleaning material supply and take-up rolls and a compliant touch roll, all mounted on a carriage adjacent to a process roll. Touch roll and cleaning material are movable by air cylinders into and out of contact with the process roll. The touch roll is rotatable in one direction only with the take-up roll. A drive motor winds the take-up roll to incrementally and uniformly advance the cleaning material over the touch roll. Period and frequency of the cleaning cycle and sub-cycles are variable by microprocessor control. Supply roll and take-up roll are supported in retractable gudgeons for easy mounting and removal.

EPC Patent Application EP 0 756 215 A2, filed Jul. 24, 1996, published Jan. 29, 1997—A contact cleaner roll cleaning system is disclosed, which includes a frame (12) to support the system relative to a moving web (10) having a first major surface and a second major surface, a first rotatable contact cleaner roll (74) supported on the frame disposed for rolling contact with the first major surface of the web, a second rotatable contact cleaner roll (80) supported on the frame disposed for rolling contact with the second major surface of the web, the second rotatable contact cleaner roll having an axis parallel to the axis of the first rotatable contact cleaner roll, the first contact cleaner roll and the second contact cleaner roll being positioned on the frame to support and guide the moving web in a substantially "S" shaped path.

Thus, there is a need for a system to produce high quality web cleaning systems which produce higher yields by more effectively removing dirt particles from devices such as coated or uncoated flexible web electrostatographic imaging members.

BRIEF SUMMARY OF THE INVENTION

It is, therefore, an object of the present invention to provide an improved cleaning system which overcomes the above-noted deficiencies.

It is another object of this invention to provide a cleaning system that facilitates coating of a variety of webs, some of which carry durable, strongly adhering coatings and some of which carry delicate, poorly adhering coatings.

It is still another object of this invention to provide a cleaning system which can be positioned closer to cleaning stations.

It is yet another object of this invention to provide a cleaning system that may be utilized in an explosive environment.

It is another object of this invention to provide a cleaning system which reduces the likelihood of deposition of dirt particles between cleaning and coating.

It is still another object of this invention to provide a cleaning system which controls contamination in web cleaning environments where flammable solvents are used to form coatings.

It is yet another object of this invention to provide a cleaning system that reduces the number of idler and other types of guide rolls which accumulate static charge that attract undesirable particles which ultimately transfer to a web being coated.

It is still another object advantage of this invention to provide a cleaning system that provides the option for a web to bypass contact cleaning rolls without contacting the rolls, or to be cleaned by contacting the contact cleaning rolls without a major web path change.

It is another object of this invention to provide a cleaning system that has a smaller footprint.

It is yet another object of this invention to provide a cleaning system that may be used in an explosive atmosphere where other cleaning systems cannot be located.

BROADEST DESCRIPTION OF THE INVENTION

The foregoing objects and others are accomplished in accordance with this invention by providing a contact cleaner roll cleaning system comprising a stationary frame, a rotatable frame, the rotatable frame being rotatable about an axis while supported by the stationary frame, the rotatable frame supporting a first contact cleaning roll that is rotatable about an axis, the first contact cleaning roll being spaced from and parallel to the axis of the rotatable frame, and a second contact cleaning roll that is rotatable about an axis, the second contact cleaning roll being spaced from the first contact cleaning roll and parallel to both the axis of the rotatable frame and the axis of the first contact cleaning roll, and a web transport device disposed to feed a web along a predetermined path between the first contact cleaning roll and the second contact cleaning roll, the web having a first major surface and a second major surface on the opposite sides of the web, the major surfaces being parallel to the axes of the first and second cleaning rolls when fed between the first contact cleaning roll and the second contact cleaning roll.

The contact cleaner roll cleaning system of this invention also includes providing a first contact cleaning roll spaced from and parallel to a second contact cleaning roll to form an opening between the rolls, transporting a web in a straight path through the opening between the rolls, the web having a first major surface and a second major surface on the opposite sides of the web, and simultaneously transporting the first contact cleaning roll and second contact cleaning roll through different arc shaped paths which lie in a common circle whereby the first contact cleaning roll and second contact cleaning roll each separately contact and alter the path of the web.

DESCRIPTION OF THE DRAWINGS

A more complete understanding of the present invention can be obtained by reference to the accompanying drawings wherein.

Figure 1:
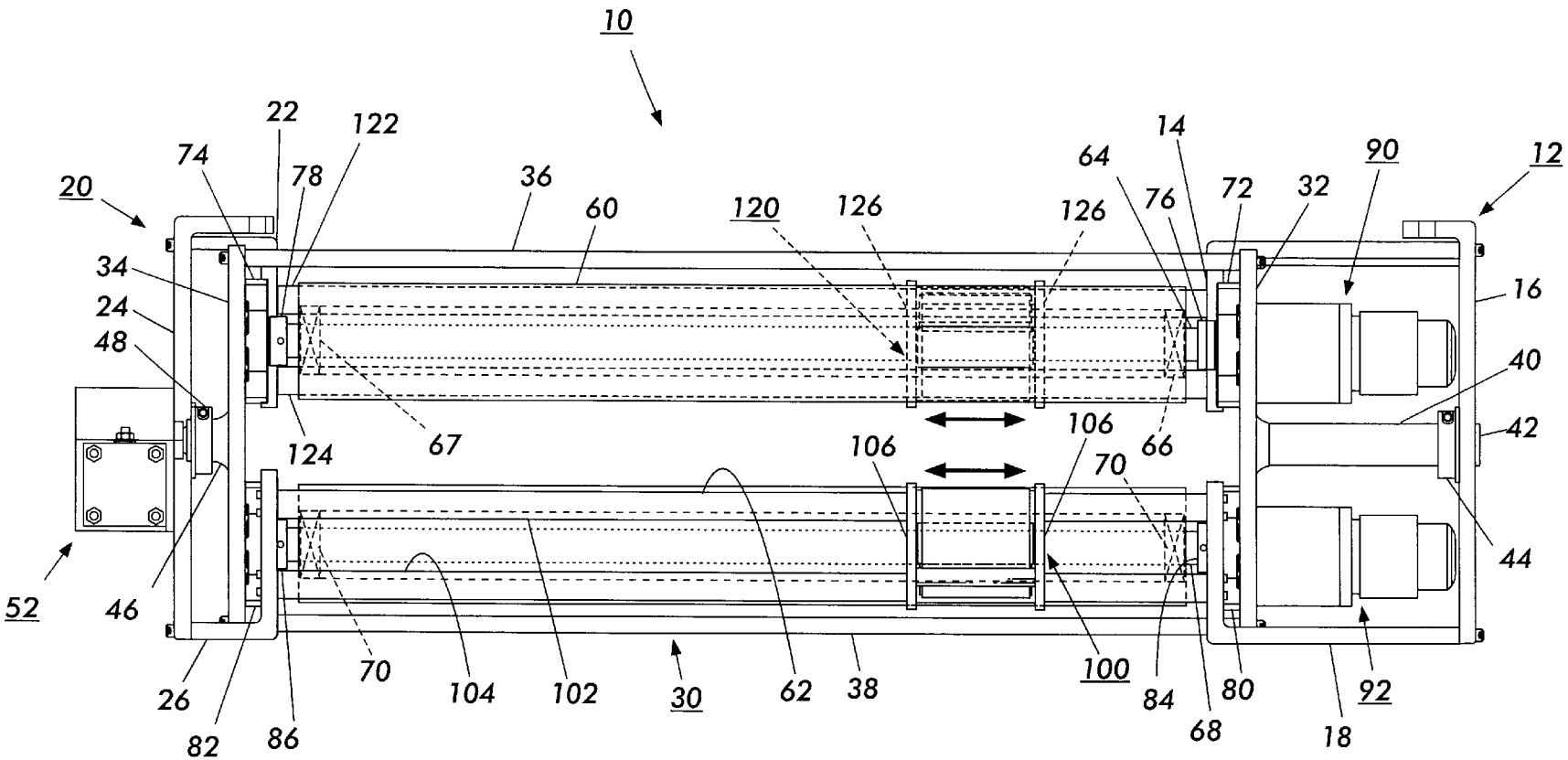
FIG. 1 is a schematic plan view of a cleaning system assembly of this invention in which contact cleaner rolls clean a web or allow web bypass.

The figures are merely schematic illustrations of the prior art and the present invention. They are not intended to indicate the relative size and dimensions of a contact cleaning system or components thereof.

DETAILED DESCRIPTION OF THE DRAWING

Figure 2:
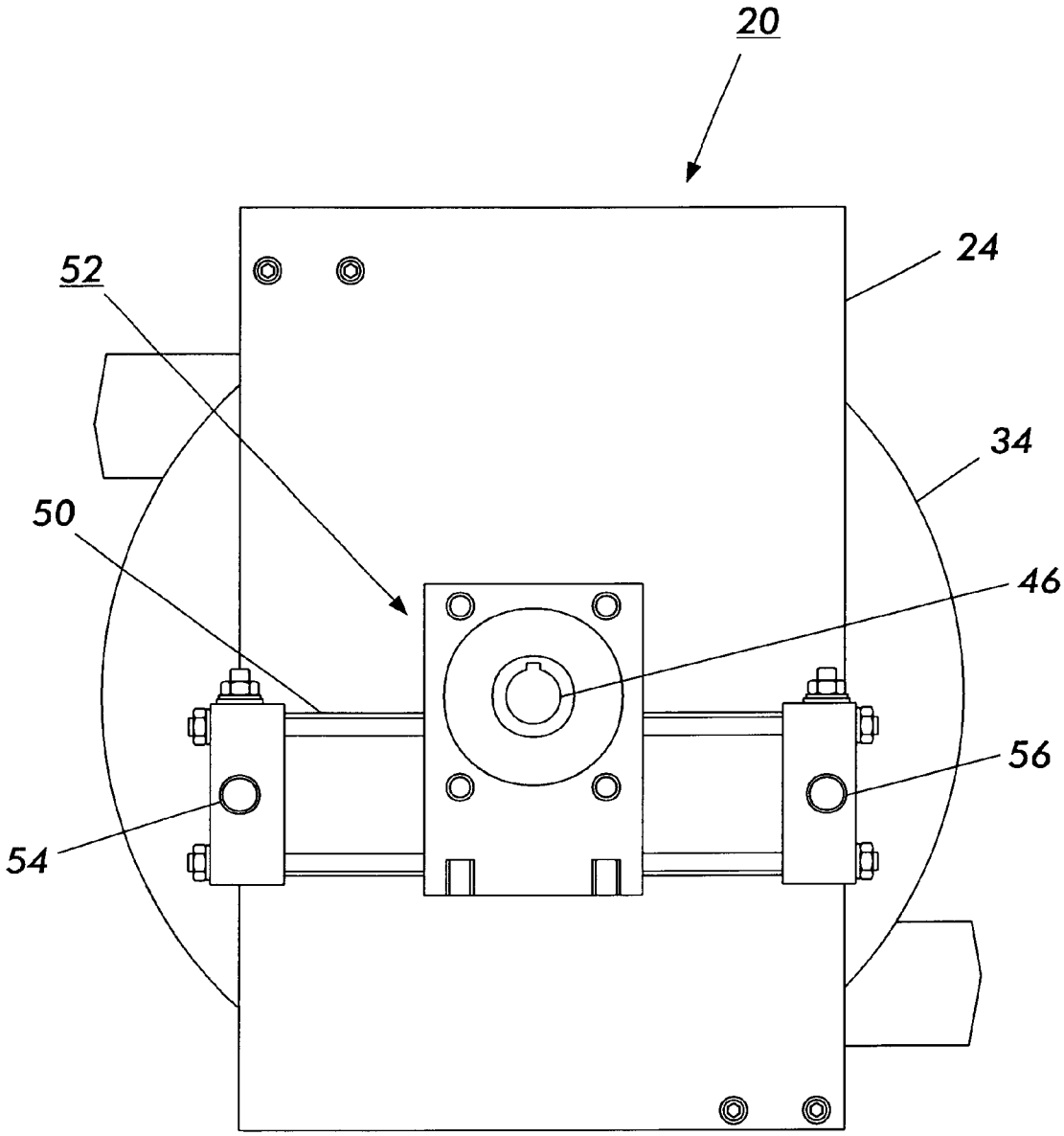
FIG. 2 is a schematic end view of the cleaning system assembly shown in FIG. 1.
Figure 3:
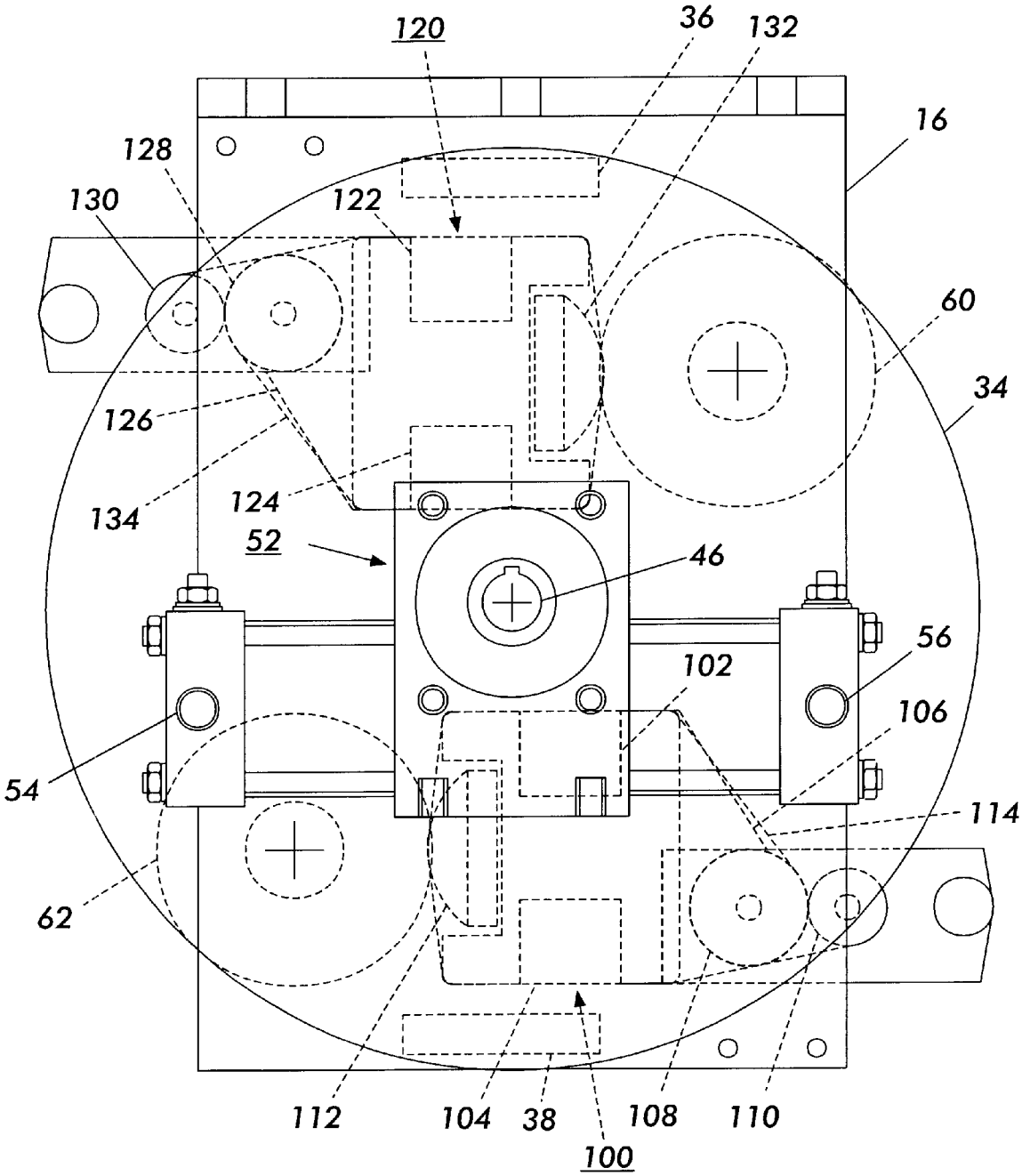
FIG. 3 is a schematic end view of the cleaning system assembly shown in FIG. 1 with a phantom view of interior components of the assembly.

Referring to FIGS. 1 through 3, a rotatable contact cleaning system assembly 10 is shown. Assembly 10 comprises a stationary frame 12 comprising frame elements 14, 16 and 18 and stationary frame 20 comprising frame elements 22, 24 and 26. Assembly 10 also comprises a rotary or rotatable frame 30 comprising rotatable end frame elements 32 and 34 and connecting struts 36 and 38. One end of a rotatable shaft 40 is fastened to rotatable end frame element 32 by any suitable technique such as by welding, threaded hole to receive a threaded shaft end, and the like. The opposite end of rotatable shaft 40 is rotatably mounted in bearing 42 which in turn is supported by frame element 16. A collar and set screw combination 44 may be employed to position rotatable shaft 40 relative to frame element 16. Similarly, one end of a rotatable shaft 46 is fastened to rotatable end frame element 34 by any suitable technique such as by welding, threaded hole and threaded shaft end, and the like. The opposite end of rotatable shaft 46 is rotatably mounted in a bearing (not shown) supported by frame element 24. A collar and set screw combination 48 may be employed to position rotatable shaft 46 relative to frame element 24. Part of shaft 46 extends through frame element 24 (see FIGS. 2 and 3). This extended portion of shaft 46 contains a (keyway) (not shown) for engagement with the (keyway) of a reciprocatable rack gear (not shown) of an air rotary actuator 52 (reversible air driven rotary cylinder) (see FIGS. 1, 2 and 3) or any other suitable indexing device. Air rotary actuator 52 comprises a two way acting piston (not shown) in housing 50. The two way acting piston is actuated by compressed air entering port 54 and exhausted through port 56 for movement in a first direction and compressed air entering port 56 and exhausted through port 54 for movement in a second direction. Control of the direction of compressed air and exhaust air may be accomplished by any suitable and conventional system of valves between the ports and a source of compressed air. The valves may be controlled by signals from any suitable programmable controller (not shown). If desired, any other suitable gas or liquid under pressure may be substituted for air. Movement of the reciprocatable rack gear by means of the piston in a first direction causes the rotary frame 30 to partially rotate on a common axis in a first direction through a predetermined number of degrees from a home position and movement of the reciprocatable rack gear by means of the piston in a direction opposite the first direction causes the rotary frame 30 to rotate in a direction opposite the first direction back to a home position. Air rotary actuators are commercially available such as Rotomatic, available from Rotomation Inc. Any other suitable device such as a reversible air motor connected to shaft 46 directly or connected through a transmission may be used to rotate rotary frame 30. Any suitable material may be utilized for the frame elements. Typical materials include, for example, stainless steel, plated or painted steel, anodized aluminum, and the like.

Mounted for rotation with rotary frame 30 are a first contact cleaning roll 60 and a second contact cleaning roll 62 (see FIGS. 1 and 3). Contact cleaning rolls 60 and 62 have a tacky exterior surface. The opposite ends of the first contact cleaning roll 60 are mounted on a first shaft 64 using one way bearings 66 and 67 and similarly, the opposite ends of the second contact cleaning roll 62 are mounted on a second shaft 68 using one way bearings 70 and 71. The outer periphery of one way bearings 66 and 67 are secured to the inner surface of roll 60 and the outer periphery of one way bearings 70 and 71 are secured to the inner surface of roll 62 by any suitable technique such as a press fit, adhesive, and the like. Also, the opening in each of these one way bearings are secured to the shaft protruding therethrough. The ends of shaft 64 are fastened to bearings 72 and 74 which do not impede shaft 64 from freely rotating in either direction. Similarly, the ends of shaft 68 are fastened to bearings 80 and 82 which do not impede shaft 68 from freely rotating in either direction. However, one way bearings 66 and 67 allow the contact cleaning roll 60 to freely rotate in one direction, but not in the opposite direction relative to shaft 64. Similarly, one way bearings 70 and 71 allow the contact cleaning roll 62 to freely rotate in one direction, but not in the opposite direction relative to shaft 68. This permits the cleaning rolls 60 and 62 to free wheel when contacted by a moving web having a first major surface and a second major surface on opposite sides of the web (see FIGS. 5 and 6) to be cleaned. Any suitable one way bearing may be utilized. Typical one way bearings may comprise a pawl and ratchet combination similar to the conventional anti-reverse system of fishing reels (allows reel handle to turn in one direction, but not the other), dual bearing containing a clutch (allows free wheeling in one direction, but allows driving in the opposite direction), and the like. One way bearings are well known and commercially available, for example, #8 USF-1½ bearings from Boston Gear, Massachusetts and drawn cup roller bearings from Torrington Company, Connecticut. One way bearings are preferred because they avoid large bulky gear boxes. Collar and set screw combinations 76 and 78 permit adjustment of the spacing between the ends of roll 60 and the adjacent rotatable end frame elements. Similarly, collar and set screw combinations 84 and 86 permit adjustment of the spacing between the ends of roll 62 and the adjacent rotatable end frame elements. The free ends of shafts 64 and 68 extend through end frame element 32 to connect with drive systems 90 and 92, respectively. The axes of the contact cleaning rolls 60 and 62 are preferably parallel to and spaced from each other and parallel to and spaced from the axis of rotary frame 30 to ensure adequate web handling and guiding with the first contact cleaning roll contacting the first major surface of a web to be cleaned and the second contact cleaning roll simultaneously contacting the second major surface of the same web. Drive systems may comprise any suitable drive device. Typical drive systems include, for example, a bi directional air motor with speed reducing gear box and the like. Preferably, the drive systems are air gear motor systems suitable for operation in explosive environments. A typical air gear motor system is a Gast ⅓ horsepower air gear motor available from Gast Manufacturing, Inc. This system comprises an air driven motor and a transmission gear box. The transmission gear box facilitates achievement of the desired torque to overcome friction between the outer surface of the contact cleaning roll and a roll cleaner device described in detail below. Air may be supplied to the air driven motor by any suitable source, for example, a compressed air tank (not shown). Control of the air may include, for example, solenoid valves operated by a conventional controller (not shown). Thus, the first contact cleaning roll 60 and second contact cleaning roll 62 are both supported by rotary frame 30 having an axis of rotation parallel to and spaced from the first contact cleaning roll 60 spaced from and parallel to a second contact cleaning roll 62.

As illustrated in FIGS. 1 and 3, a second reciprocatable roll cleaner assembly or member 100 is slidably mounted on a pair of parallel hollow nonmagnetic rods or members 102 and 104. The ends of rods 102 and 104 are supported by stationary frame elements 18 and 26. Parallel rods 102 and 104 are hollow and each contain a two way acting piston (not shown) actuated by compressed air entering a port at one end of the rods and exhausted or vented at a port (not shown) at the opposite end for movement of the piston in a first direction within the interior of the rods, followed by reversing the input and exhaust functions of the ports for movement of the piston in a second direction. Control of the direction of compressed air and exhaust air may be accomplished by any suitable and conventional system of valves between the ports and a source of compressed air. If desired, any other suitable gas or liquid under pressure may be substituted for air. Introduction and exhausting of the air into and out of the ends of rods 102 and 104 are carried out synchronously to reciprocate the roll cleaner assembly 100 back and forth on rods 102 and 104 during a cleaning cycle. For the sake of convenience, rods 102 and 104 in combination with the pistons are collectively referred to as a second air powered device. Since the reciprocating pistons in rods 102 and 104 are magnetically coupled to roll cleaner assembly 100 (magnets may be employed in the reciprocating pistons and/or the roll cleaner assembly 100), movement of the pistons causes movement of roll cleaner assembly 100 in a like direction. Roll cleaner assembly 100 comprises a pair of spaced frame ends 106 carrying a rotatable feed roll 108, a rotatable take up roll 110, and a porous resilient sponge 112 (see FIGS. 1 and 3). A fibrous web 114 extends from feed roll 108, over sponge 112 and onto take up roll 110. Any suitable web may be utilized. The web may comprise woven or non-woven synthetic or natural fibers. Sponge 112 may comprise any suitable resilient open pore material. Typical resilient open pore materials include, for example, cellulose sponge, open cell polyurethane, and the like. A reservoir (not shown) is coupled with sponge 112 to periodically or continuously feed cleaning liquid to sponge 112 to facilitate cleaning when the fibrous web 114 is contacted with the outer surface of contact cleaning roll 62. The structure of large sized roll cleaner assemblies are known and described, for example, in U.S. Pat. Nos. 5,855,037, 5,251,348 and 5,275,104, the entire disclosures thereof being incorporated herein by reference. Roll cleaner assembly 100 is a smaller, more compact version of large roll cleaner assemblies and are commercially available, e.g., from Micro Roll Cleaner from R. G. Egan, located in Webster, N.Y. The roll cleaner assembly 100 may be used to clean a small incremental area on the contact cleaning rolls more frequently and be completely automated. Conventional web cleaning systems are much larger and are not explosion proof and must be located in a non-explosive area of a coating system where there is adequate space and no flammable fumes.

Similarly, as also shown in FIGS. 1 and 3, a first reciprocatable roll cleaner assembly or member 120 is slidably mounted on a pair of parallel hollow nonmagnetic rods or members 122 and 124. The ends of rods 122 and 124 are supported by stationary frame elements 14 and 22. Parallel rods 122 and 124 are identical in construction and function as parallel rods 102 and 104 described above. For the sake of convenience, rods 122 and 124 in combination with the pistons are collectively referred to as a first air powered device. Since the reciprocating pistons in rods 122 and 124 are magnetically coupled to roll cleaner assembly 120, movement of the pistons causes movement of roll cleaner assembly 120 in a like direction. Roll cleaner assembly 120 comprises a pair of spaced frame ends 126 carrying a rotatable feed roll 128, a rotatable take up roll 130, and a porous resilient sponge 132. A fibrous web 134 extends from feed roll 128, over sponge 132 and onto take up roll 130. A reservoir (not shown) is coupled with sponge 132 to intermittently or continuously feed cleaning liquid to sponge 132 in a manner identical to that described above with reference to the operation of roll cleaner assembly 120. Thus, a stationary frame 12 supports a first reciprocatable cleaning member 120 which contacts a first contact cleaning roll 60 and a second reciprocatable cleaning member 100 which contacts a second contact cleaning roll 62 when the rotatable frame 30 supporting the first and second contact cleaning rolls is in a home position.

Figure 4:
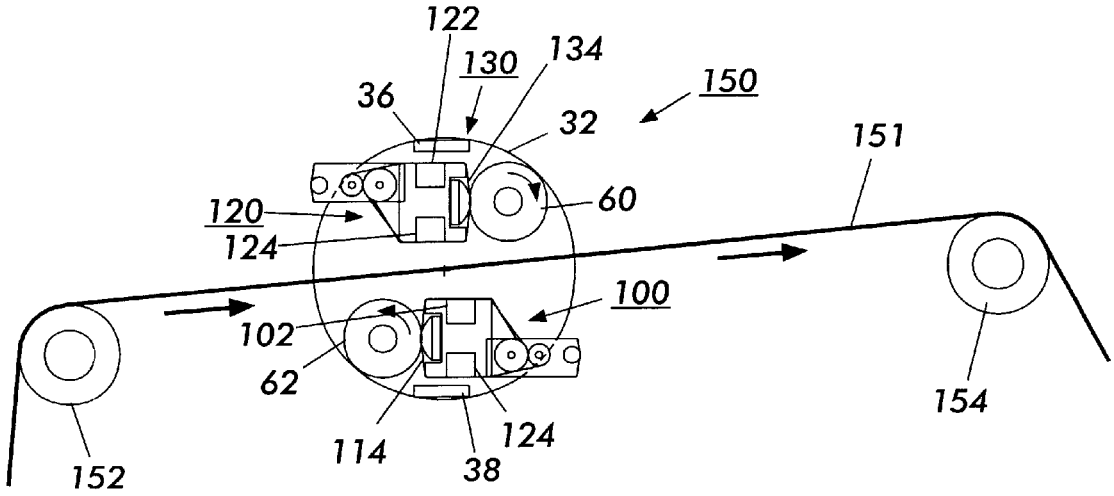
FIG. 4 is a schematic cross sectional view in elevation of a cleaning system assembly shown in a web bypass mode.

Illustrated in FIG. 4 is a simplified schematic cross sectional illustration of the rotatable contact cleaning assembly 150 in an inactivated/contact roll cleaning mode which allows a flexible web 151 having a major plane and supported by idler rolls 152 and 154 to pass through rotatable contact cleaning assembly 150 along a straight predetermined path between and out of contact with contact cleaning roll 60 and contact cleaning roll 62. In the inactivated/contact roll cleaning mode, e.g. home position, the contact cleaning rolls 60 and 62 are in pressure contact with the fibrous webs 134 and 114, respectively, backed by a wetted resilient sponge. This inactivated mode allows webs carrying fragile coatings to be coated in the same coating system without requiring rerouting of the web path. Since a web coating system can comprise numerous coating and drying stations, a change in the type of coating applied to a web from a durable coating to fragile coating normally requires re-threading of the web through the coating system. This re-threading operation was laborious and resulted in considerable system down time. Even if a different web, instead of the same web, is to be coated with a fragile coating, threading of the new different web can be accomplished automatically by merely fastening (e.g., by using an adhesive tape) the lead end of the new web to the tail end of the web already in the coating system, the fastening being accomplished at the feed roll station of the coating system. This allows the tail end of the web already in the coating system to pull the lead end of the new web through the entire coating system thereby accomplishing automatic threading. However, such automatic threading is not possible if the route of the new web (or the route of a web already in the coating system) must be altered to bypass one or more contact cleaning systems to allow application of a fragile coating. Moreover, rotation of the rotary frame 30 transports contact cleaning rolls 60 and 62 away from the web 151 and avoids the necessity of cutting the web to bypass the contact cleaning rolls to allow experiments to be carried out or when coating extremely sensitive or fragile coatings are used. Further, in the event that the web coating line must be stopped, rotatable contact cleaning assembly 150 may be placed in the inactive mode by rotation of the rotary frame 30 a predetermined number of degrees to transport contact cleaning rolls 60 and 62 away from the web 151 thereby minimizing contact time between the contact cleaning rolls 60 and 62 and web 151 while the web is stationary. This can prevent sticking of the web 151, particularly a coated web, to the adjacent contact cleaning roll when the coating line is restarted. Sticking of the contact cleaning rolls to a coating on web 151 can cause damage to the coating when the coating line is restarted. Moreover, rotatable contact cleaning assembly 150 may be placed in the inactive mode even when the web 151 is running without stopping the line. This might be done because a fragile coating is to be applied, repair or replacement of a component of assembly 150 is desirable, or for any other reason. Thus, the cleaning system of this invention can be bypassed or engaged quickly by a simple rotation movement, without cutting the web or stopping the coating process. This versatility is important for trouble shooting, conducting coating experiments or the like.

Also, while the contact cleaning roll 60 and contact cleaning roll 62 are out of contact with web 151, air gear motors 90 and 92 (see FIG. 1) may be activated by supplying pressurized air to the motors to cause rotation of contact cleaning rolls 60 and 62. Typical revolutions per minute for contact cleaning rolls having a diameter of between about 8.7 and about 9 centimeters is between about 160 rpm and about 200 rpm while the rolls are being cleaned. The direction of rotation of the contact cleaning rolls when driven by the air gear motors is opposite the direction that the rolls free wheel during contact with the moving web 151. At about the same time, air may be supplied to a first end of hollow parallel rods 102, 104, 122 and 124 to move the two way acting pistons therein to move roll cleaner assemblies 100 and 120 from a home position in the same direction as the two way acting pistons thereby causing the roll cleaner assemblies 100 and 120 to traverse and clean the rotating surfaces of adjacent contact cleaning rolls 62 and 60, respectively. Upon completion of traverse, air may be supplied to a second end of hollow parallel rods 102, 104, 122 and 124 (the first end being vented) to reverse the direction of traverse of the roll cleaner assemblies 100 and 120 so that they return to the home position. If desired, any other suitable device may be substituted for the two way acting piston systems. Typical devices for providing reciprocation movement include, for example, ball and lead screw combinations (preferably driven by air motors), chain & sprocket, linear motors, and the like. The paths of traverse of the reciprocated roll cleaner assemblies are parallel to the axis of the adjacent contact cleaning roll. Although a single cycle of traverse from one end of the contact cleaning rolls 60 and 62 to the other and return can be sufficient to clean and regenerate (renew to substantially the original tackiness) the rolls, additional traverse cycles may be employed, if desired. A typical traverse rate for the roll cleaner assemblies is between about 5 centimeters per second and about 10 centimeters per second. The amount of pressure contact between the outer surface of the contact cleaning rolls and the fibrous web backed by a resilient sponge, should be sufficient to clean and regenerate the rolls. The specific amount of pressure employed can vary and depends upon the specific tacky material on the rolls, the composition of the dirt deposited on the roll, the composition of the cleaning fluid, the rotational speed of the cleaning roll, the traverse speed of the cleaning web, and the like.

Figure 5:
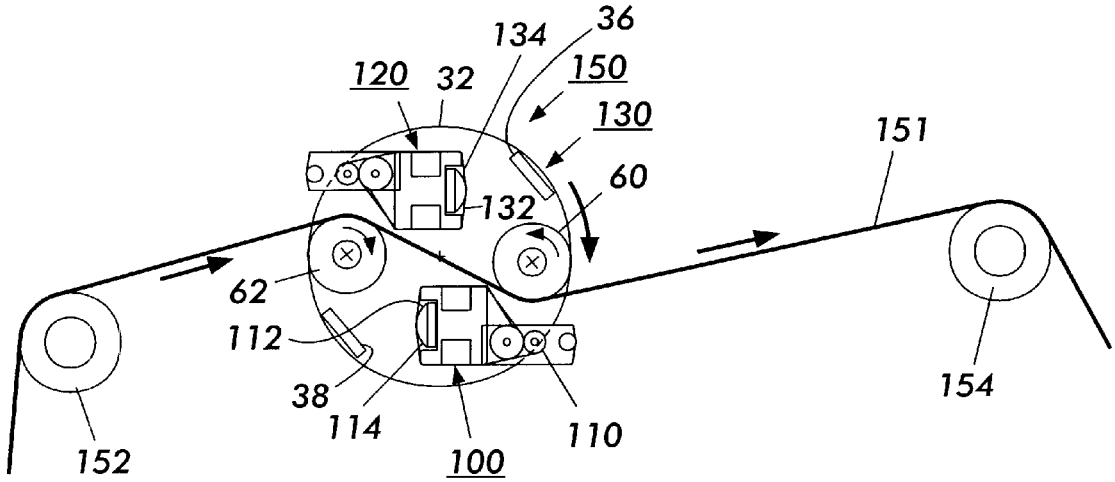
FIG. 5 is a schematic cross sectional view in elevation of a cleaning system assembly shown in a web cleaning mode.

With reference to FIG. 5, activation of air rotary actuator 52 rotates shaft 46 and rotatable end frames 34 and 32 (see FIGS. 1–3 and 5) to rotate rotary frame 30 a predetermined number of degrees from a home position and transport contact cleaning roll 60 and contact cleaning roll 62 through different arc shaped paths which lie in a common circle whereby contact cleaning roll 60 and second contact cleaning roll 62 each separately contact the first and second major surfaces on opposite sides of web 151 to deflect and alter the path of the web. Contact of the rolls with the web may occur sequentially or simultaneously. The direction of travel of web 151 is in a direction in which contact cleaning roll 60 and contact cleaning roll 62 are free wheeling. Due to the tacky exterior surface of contact cleaning rolls 60 and 62 and sufficient deflection of the web by the rolls 60 and 62, the web 151 drives rolls 60 and 62 at a rate at which the surface speed of the rolls is synchronous with the web speed. In other words, contact between the transported web and the contact cleaning rolls rotate the contact cleaning rolls. Generally, synchronous contact between the contact cleaning roll and the web surface to be cleaned is preferred to prevent any scrubbing action which can remove material from either the contact cleaning roll and/or the web surface to be cleaned. This also prevents the formation of scratches on either the surface of contact cleaning roll or the surface of the web substrate to be cleaned. Any suitable wrap angle of the web on the contact cleaning rolls may be utilized. The amount of rotational movement of the end mounts 32 and 34 carrying the contact cleaning rolls should be sufficient to ensure sufficient contact between the contact cleaning rolls and the web surface to be cleaned. Typical amounts of rotatable end frame rotation includes, for example, between about 10° and about 50°, although other degrees of rotation may be utilized so long as the objectives of this invention are met. Generally, the contact between the web being cleaned and the contact cleaning roll surface is tangential with a slight deflection of the web. The amount of rotation of the rotatable end frame should also be such that the cleaning rolls do not strike the reciprocatable cleaning head. A typical end mount rotation is about 45°. Generally, a contact or wrap angle between the web being cleaned and the contact cleaning roll of more than about 6° of arc, measured in the direction of web travel is preferred because this ensures maximum contact, even tension. also ensures uniform roller to web speed. It also provides adequate contact time for particles to adhere to the cleaning roll. Angles less than about 6° degrees may result in slippage between the cleaning roll surface and the web and lead to inefficient cleaning of the web. The cleaning system of this invention enables simultaneous cleaning of both sides of web 151 by mere partial rotation of the rotary frame 30 of contact cleaning assembly 150. Contact cleaning roll 60 removes dirt particles from one major surface of web 151 and contact cleaning roll 62 removes dirt particles from the major surface on the opposite side of web 151. If desired, while the contact cleaning rolls are out of contact with the roll cleaner assemblies 100 and 120, the take up rolls 110 and 130 may be rotated to transport fresh unused cleaning web material over sponges 112 and 132, respectively. Rotation may be accomplished by any suitable conventional device such as an air driven motor with air supply be controlled by conventional valves and signals from a programmable controller (not shown). A typical programmable controller is Model No. 550, available from Allen-Bradley. Although manual control may be employed, one or more programmable controllers are preferably used to control all of the air driven subsystems of the contact cleaning system of this invention. Since the signals from a programmable controller are electrical, electrically activated devices such a solenoid controlled valves are preferably located outside of a contact cleaning area, if the contact cleaning area contains explosive vapors.

Figure 6:
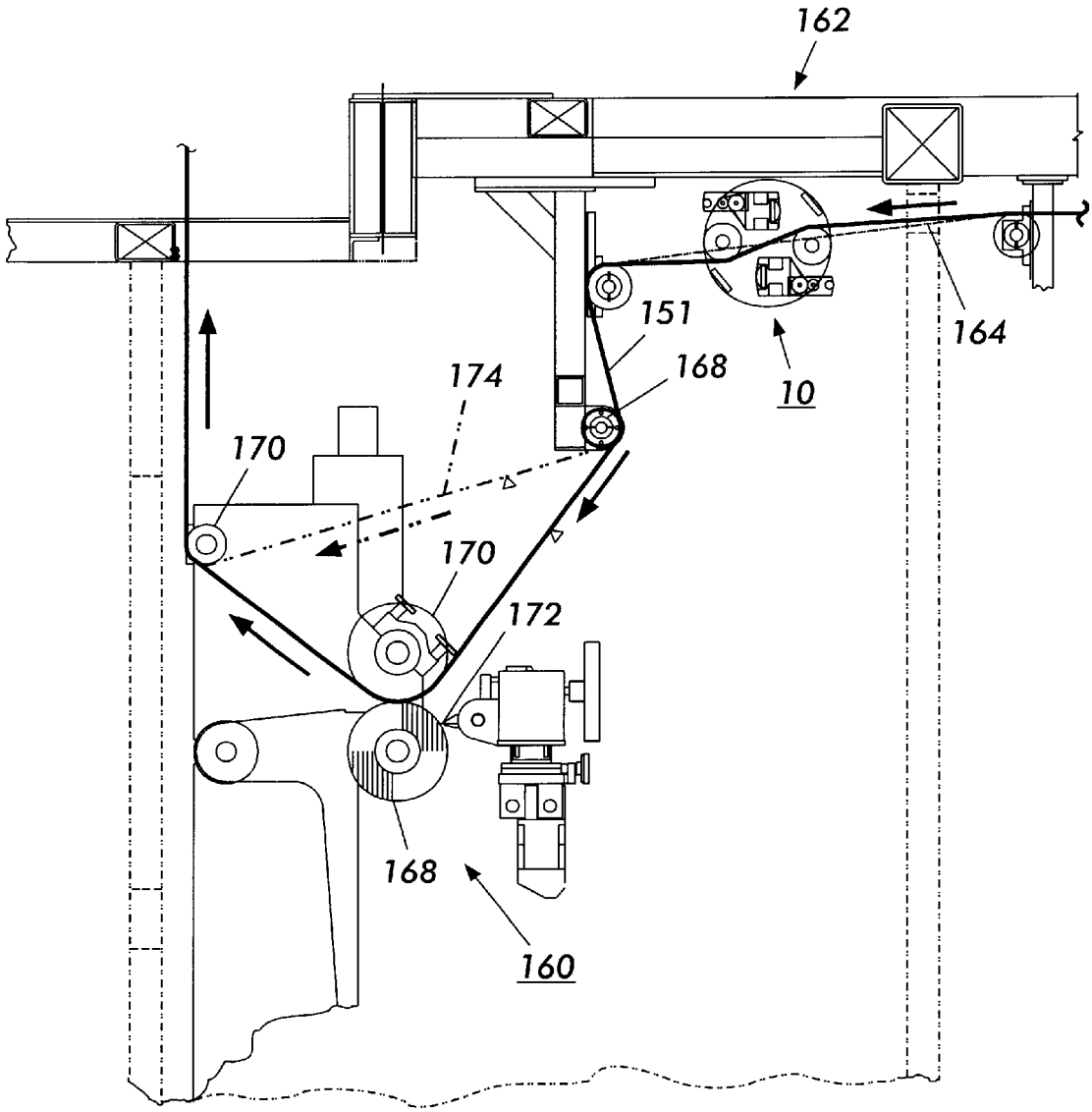
FIG. 6 is a schematic view in elevation of a web coating system juxtaposed with a web cleaning system assembly in an explosion proof chamber.
Figure 7:
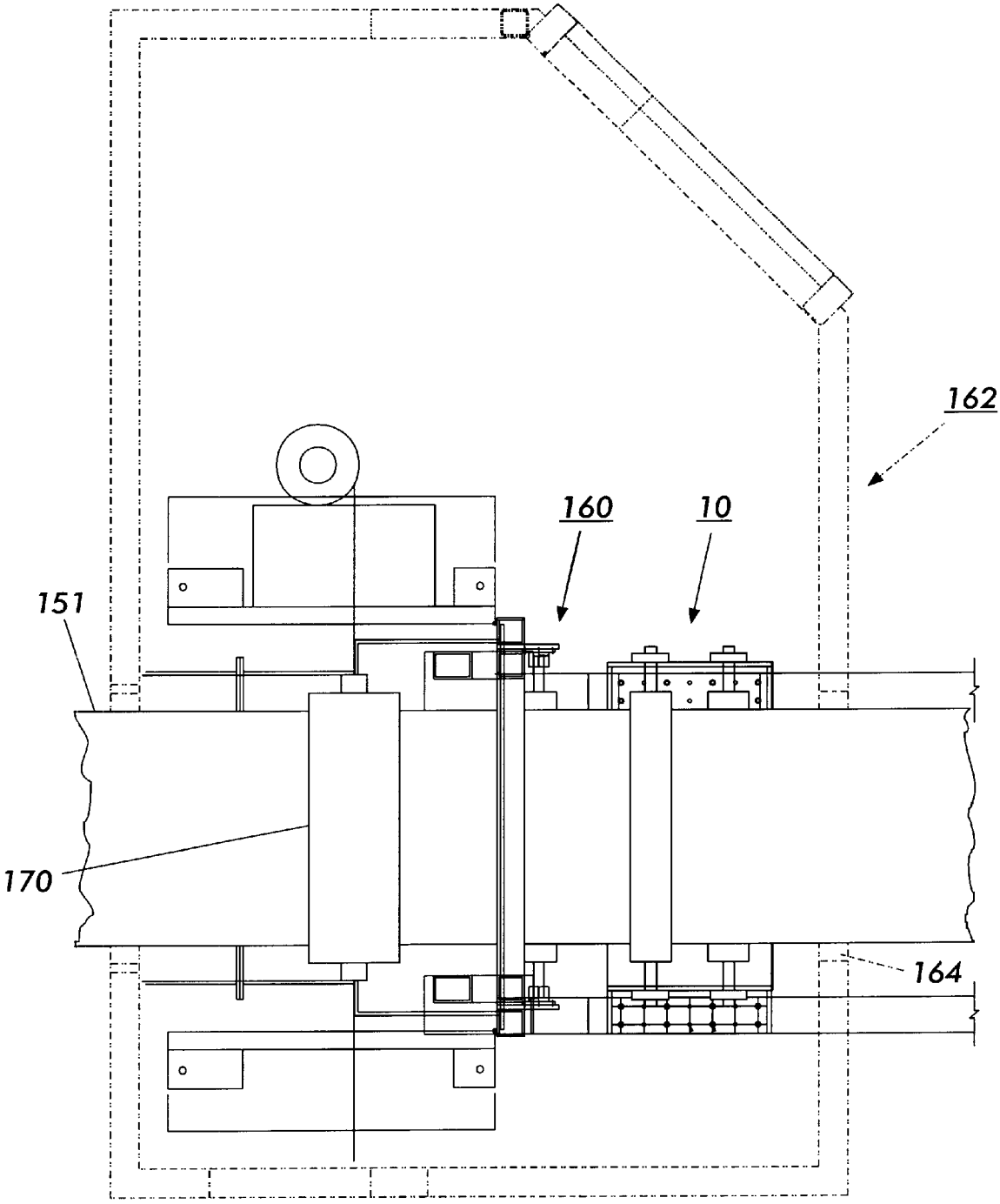
FIG. 7 is a schematic plan view of the web coating system and web cleaning system assembly shown in FIG. 6.

In FIGS. 6 and 7, a combination of a rotatable contact cleaning system assembly 10 and a coating system 160 is illustrated in an explosion proof enclosure 162. Explosion proof enclosure 162 is essentially sealed except for small web entrance slot 164 and a web exit slot (not shown). At least during coating operations, enclosure 162 is maintained under negative pressure to prevent escape of flammable solvents. Any suitable technique may be utilized to maintain negative pressure. Typical techniques include the use of air motor driven exhaust fans, electric motor driven fans located outside the enclosure, and the like. Coating system or device 160 comprises a gravure applicator roll 168, a backing roll 170, a coating material source (not shown), and a doctor blade 172. Any suitable coating system such as an extrusion system, reverse roll system or the like may be substituted for the gravure coating system 160. If desired, web 151 may be routed from idler roll 168 directly in a straight path to idler roll 170 to bypass coating system 160 (see phantom line in FIG. 6). Although rails, articulated arms or other linear reciprocating devices may be used to move contact cleaning rolls into and out of contact with the web to be cleaned, they require more space and present greater alignment problems. Thus, a rotatable contact cleaning system carrying at least a pair of spaced contact cleaning rolls is preferred.

When the compact contact cleaning system of this invention is employed in an explosion proof environment, the various drive devices should be explosion proof. Preferred explosion proof drive devices are air driven. However, any other suitable explosion proof drive device may be substituted for the air driven devices. Other typical explosion proof drive devices include, for example, explosion proof rated electric motors and the like. When the compact contact cleaning system of this invention is employed in an environment that presents no danger of explosion, explosion proof or non-explosion proof drive devices may be utilized, e.g., ordinary electric motors.

There does not appear to be any criticality in the diameter of a contact cleaning roll. However, smaller diameter contact cleaning rolls have less surface available for accumulating dirt particles and tend to become dirty more rapidly. Moreover, a small diameter cleaning roll can bend if the roll is too long or if it comprises material that is too soft. Large diameter rolls can increase the space occupied by the contact cleaning system.

The contact cleaning surface of the contact cleaning rolls may comprise a deposited tacky coating on a supporting core member or it may make up the entire cleaning member. A soft conformable contact cleaning material at the surface of the cleaning roll is preferred to ensure greater surface area of contact between the contact cleaning surface and the dirt particles than between the dirt particles and the web being cleaned. Thus, the durometer of the contact cleaning material is preferably less than the durometer of the materials of the web to be cleaned.

Any suitable tacky cleaning material may be used on the contact cleaning rolls. Typical tacky cleaning materials include the medium tack materials utilized in "Post-it®" sheets available from the 3M Company. A square test sample having a width of about 5 centimeters of paper coated with medium tack materials such as employed in Post-it® type adhesives will stick to a human finger when the finger is pressed against the adhesive surface and thereafter lifted. These test samples will retain a dirt particle having an average particle size of between about 0.5 micrometer and about 100 micrometers when the test sample is pressed against the particle and lifted away from any smooth surface upon which the dirt particle originally rested. This test defines the expression "medium tack surface" as employed herein. Tacky materials employed in the medium tack coating are believed to contain tacky polymeric elastomeric alkyl acrylate or alkyl methacrylate ester material. Typical medium tack materials are disclosed, for example, in U.S. Pat. No. 4,994,322, the entire disclosure thereof being incorporated herein by reference.

The tacky rubber materials utilized in the contact cleaning rolls can have a low tack. The expression "low tack" as employed herein is defined as a tacky surface to which dirt particles having a size less than about 100 micrometers adhere, but to which a human finger does not adhere. Thus, a square test sample piece having a thickness of about 2 millimeters and a width of about 1 centimeter cannot be picked up when a human finger is pressed down against the sample and thereafter lifted. However, when the test sample is pressed against a dirt particle having an average particle size of between about 0.5 micrometer and about 100 micrometers, the dirt particle will adhere to the test sample when the test sample is lifted away from any smooth surface upon which the dirt particle originally rested. The low tack materials utilized in the contact cleaning rolls may comprise any suitable adhesive material. Typical low tack materials include, for example, polyurethane, natural rubber, and the like. A typical low tack rubbery cross-linked polyurethane material is available from Polymag, Rochester, N.Y. and R. G. Egan, Webster, N.Y. The low tack rubbery cross-linked polyurethane material has a durometer of about 15–35 Shore A. Low tack rubbery cross-linked polyurethane materials are described in U.S. Pat. No. 5,102,714 and U.S. Pat. No. 5,227,409, the entire disclosures thereof being incorporated herein by reference.

The amount of adhesion of the contact cleaning roll surface to the web surface during contact cleaning should be less than the peel strength of any coating being cleaned on the web to ensure that when the contact cleaning roll surface is separated from the surface being cleaned, the coating remains undamaged on the web. Since the peel strength of coatings on the web varies with the type of materials employed in the web and in coating, the amount of tack exerted by a contact cleaning roll can vary depending upon the specific materials employed in web and any coating thereon. For example, a low tack contact polyurethane contact cleaning roll surface is preferred for cleaning webs that are vacuum coated with thin lightly adhering coatings. However, the amount of tackiness on a contact cleaning member surface should also be sufficient to remove particles having an average particle size between about 0.5 micrometer and about 100 micrometers when the contact cleaning surface is separated from the surface being cleaned.

The contact cleaning surface of the contact cleaning rolls should be sufficiently smooth to ensure contact between the contact cleaning surface and the dirt particles on the surface of the web to be cleaned. Thus, the contact cleaning surface should be continuous. The contact cleaning surface should also not form any deposits on the surface of the web to be cleaned because such deposits may adversely affect the quality of the final coated web member, e.g., the quality of the electrical properties of a final coated electrostatographic imaging web.

Large particles of dirt clinging to a contact cleaning member surface can emboss or even scratch a surface to be cleaned as the contact cleaning surface contacts a fresh surface to be cleaned. Thus, it is desirable that any large dirt particles have an average particle size of larger than about 100 micrometers be removed prior to bringing a contact cleaning surface into contact with the surface of the web to be cleaned. Such removal of these relatively large particles also ensures that particles are not present to mask smaller underlying particles during subsequent contact cleaning. Any suitable technique such as air jet cleaning, vacuum cleaning, air impingement, ultrasonic resonation, and the like and combinations thereof may be utilized to remove particles having an average particles size greater than at least 100 micrometers.

Although a specific preferred cleaning technique and apparatus are shown in the figures, any other suitable cleaning technique may be utilized to clean the contact cleaning rolls. The cleaning technique selected depends upon the type of dirt particles picked up by the cleaning member surfaces. Any liquid cleaning material utilized to assist in cleaning off the contact cleaning roll surface is preferably selected from materials that do not dissolve the dirt particles. Dissolving of the accumulated dirt particles can lead to absorption of the dirt into the surface of the contact cleaning member and can also lead to breakdown of the cleaning effectiveness of the contact cleaning surface. Satisfactory results have been achieved with cleaning materials comprising a mixture of water and alcohol. Typical alcohols include, for example, methanol, ethanol, isopropyl alcohol and the like. Generally, the mixture comprises between about 75 percent and about 99 percent by weight water and between about 1 percent and about 25 percent by weight alcohol. The preferred concentration comprises between about 78 and about 82 percent by weight water and between about 18 and about 22 percent alcohol.

Preferably, cleaning and coating operations for fabricating webs, such as electrostatographic imaging members, are conducted under clean room conditions such as those at least meeting the requirements of a Class 1000 Clean Room. A Class 1000 Clean Room is defined as a room in which each one cubic foot volume of space does not have a particle count of more than 1000. If desired, more stringent clean room conditions may be utilized. However, for very large coating operations occupying a large volume of space, more stringent cleaning room conditions are more difficult and more expensive to achieve. Thus, the use of a compact cleaning system in combination with a coating applicator enclosed in a small volume of space, facilitates achievement of more stringent cleaning room conditions at less expense and avoids long web runs between a cleaning station and a coating station where dirt has more of an opportunity to deposit on the web.

If desired, a plurality of the contact cleaning systems of this invention may be employed to clean the two major surfaces of a web. The web may be transported by conventional devices from a supply roll to a take up roll. Preferably, the web is maintained under tension by conventional means such as, for example, supply roll brakes, spring loaded idler rolls (not shown) and the like to ensure pressure contact with the contact cleaning roll surface during cleaning.

Electrostatographic flexible web imaging members are well known in the art. Typical electrostatographic flexible web imaging members include, for example, photoreceptors for electrophotographic imaging systems and electroceptors or ionographic members for electrographic imaging systems. Electrostatographic flexible web imaging member may be prepared by various suitable techniques. Typically, a flexible web substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. For ionographic imaging members, an electrically insulating dielectric layer is applied to the electrically conductive surface. These imaging members are well known in the art and are described, for example, in U.S. Pat. No. 5,853,037 and U.S. Pat. No. 5,685,043, the entire disclosures thereof being incorporated herein by reference. Examples of photosensitive members having at least two electrically operative layers include a charge generator layer and a transport layer are disclosed, for example, in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures of these patents being incorporated herein in their entirety. These photoreceptors may comprise, for example, a charge generator layer sandwiched between a conductive surface and a charge transport layer or a charge transport layer sandwiched between a conductive surface and a charge generator layer. Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are also well known in the art. For electrographic imaging members, a flexible dielectric layer overlying the conductive layer may be substituted for photoconductive layers. Any suitable and conventional technique may be utilized to mix and thereafter apply various coatings to the coated or uncoated web. Typical application techniques include spraying, roll coating, wire wound rod coating, extrusion die coating, curtain coating, and the like. Drying of deposited coatings may be effected by any suitable conventional technique such as oven drying, infra red radiation drying, air drying and the like. The cleaning system of this invention may be employed to clean the web before and/or after application of any of the above described coatings.

The small footprint of the web contact cleaning system of this invention, e.g., 30.4 cm×32 cm 108 cm (12 inches×12.6 inches×42.5 inches) in an explosive environment allows changing of the coating applied to the web without accessing the system to cut the web. Since the system is preferably air driven, it can be used in an explosion proof environment. Thus, for example, the contact cleaning system of this invention may be utilized in a process Class 1, Division 1, explosive zone. Since the system of this invention is very compact and can be used in the explosion proof coating enclosure, the time and space between web cleaning to coating application can be markedly reduced. The web cleaning systems of this invention can even be used in a Class 1 Div., 1 explosive environment. These attributes have a positive impact on yields, particularly for new digital color systems that cannot tolerate coating defects at size levels that would normally satisfy light lens copiers, printers and duplicators.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A supply roll of a long vacuum metalized polyethylene terephthalate web having a thickness of 75 micrometers and a width of 52 centimeters was unrolled and transported past a preliminary cleaning station containing an air knife and a vacuum nozzle which removed dirt particles having an average size of at least 100 micrometers. It is believed that some dirt particles having an average size as low as 30 micrometers may also have been removed by the preliminary cleaning station. The web was then transported through a narrow opening into a Class 1, Division 1, explosion proof clean room. The web was transported along a substantially horizontal path between two spaced apart contact cleaning rolls supported in a rotatable frame similar to that illustrated in FIGS. 1 though 7. The distance between the outer surface of the cleaning rolls was 12.7 cm. The rotatable frame was supported by a stationary frame. The axes of the two spaced apart contact cleaning rolls and the axis of the rotatable frame were parallel to each other. Also, the axis of the rotatable frame was located midway between the two spaced apart contact cleaning rolls. Each contact cleaning roll had a diameter of 89 millimeters (3.5 inches) and a length of 68.6 centimeters. Each contact cleaning roll comprised a metal core around which was molded a polyurethane rubber layer having a thickness of 13 millimeters. The polyurethane rubber layer was a low tack rubbery cross-linked polyurethane material having a durometer of about 22 Shore A and is available from R. G. Egan, Webster, N.Y. The combination of rotatable frame, stationary frame, contact cleaning rolls and roll cleaner assembly occupied a cross sectional space (in elevation) of only 0.1 square meter (~1 square foot) and a volume of 30.4 cm×32 cm 108 cm (12 inches× 12.6 inches×42.5 inches). The rotatable frame was rotated on its axis in a first direction to bring the contact cleaning rolls into contact with opposite sides of the web and cause defection of the web in a manner similar to that illustrated in FIGS. 5 and 6. The speed of the web and amount of web deflection due to contact with the surface of the contact cleaning rolls were selected to avoid slippage between the web and the contacting surface of the free wheeling contact cleaning rolls. The rate of travel of the web was maintained at 21 meters (70 feet) per minute by controlling the rate of rotation of pull rolls positioned at the downstream end of the web. Examination of the surfaces of the contact cleaning rolls after rolling contact with 900 linear meters of each major web surface revealed dirt particles having an average particle size greater than 0.5 micrometer and less than 100 micrometers. Examination of the surface of the metalized web cleaned by the contact cleaning rolls revealed no undesirable detachment of coating material from the underlying surface. The cleaned metalized web was then coated with a solution of hydrolyzed siloxane charge blocking material applied by a gravure applicator and dried in an oven drier to form a charge blocking layer having a thickness of 0.05 micrometer. The coating solution contained alcohol solvent which is flammable. After simultaneously cleaning both sides of the web, the rotatable frame was rotated in a direction opposite the first direction to convey each contact cleaning roll to a position out of contact with the web and into contact with a sponge backed fibrous cleaning web of a roll cleaner assembly similar to that illustrated in FIGS. 1, 3, 4, 5 and 6. Each roll cleaner assembly was supported on a pair of parallel two way acting air cylinders (linear drives, available from Hoerbiger-Origa) which were activated by compressed air to reciprocate each roll cleaner assembly along the length of the adjacent contacting contact cleaning roll at a rate of 8 cm per second while the contact cleaning roll was out of contact with the web. During cleaning and regeneration of each contact cleaning roll, each contact cleaning roll was rotated at 180 rpm by an air gear motor. A coated web having a uniform high quality coating was obtained.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. Apparatus comprising a stationary frame, a rotatable frame, the rotatable frame being rotatable about an axis while supported by the stationary frame, the rotatable frame supporting a first contact cleaning roll that is rotatable about an axis, the first contact cleaning roll being spaced from and parallel to the axis of the rotatable frame, and a second contact cleaning roll that is rotatable about an axis, the second contact cleaning roll being spaced from the first contact cleaning roll and parallel to both the axis of the rotatable frame and the axis of the first contact cleaning roll, wherein the first contact cleaning roll has opposite ends supported by one way bearings mounted on a first shaft and the second contact cleaning roll has opposite ends supported by one way bearings mounted on a second shaft, and a web transport device disposed to feed a web along a predetermined path between the first contact cleaning roll and the second contact cleaning roll, the web having a first major surface and a second major surface on the opposite sides of the web, the major surfaces being parallel to the axes of the first and second cleaning rolls when fed between the first contact cleaning roll and the second contact cleaning roll.

2. Apparatus according to claim 1 wherein the first shaft of the first contact cleaning roll is connected through a bearing to a first drive device and the second shaft of the second contact cleaning roll is connected through a bearing to a second drive device.

3. Apparatus according to claim 2 wherein the first drive device and the second drive device are air gear motors.

4. Apparatus according to claim 1 wherein the rotatable frame is connected to an indexing device disposed to rotate the frame from a home position through a predetermined number of degrees in a first direction and thereafter rotate the frame back to the home position.

5. Apparatus according to claim 4 wherein the indexing device comprises a reversible air driven rotary cylinder.

6. Apparatus according to claim 4 wherein the rotatable frame in the home position spaces the first contact cleaning roll and the second contact cleaning roll from the predetermined path of the web between the first contact cleaning roll and the second contact cleaning roll.

7. Apparatus according to claim 4 wherein rotation of the rotatable frame through the predetermined number of degrees in the first direction simultaneously brings the first contact cleaning roll and the second contact cleaning roll into the predetermined path of the web between the first contact cleaning roll and the second contact cleaning roll.

8. Apparatus according to claim 4 wherein the stationary frame supports a first reciprocatable cleaning member which contacts the first contact cleaning roll and a second reciprocatable cleaning member which contacts the second contact cleaning roll when the rotatable frame is in the home position.

9. Apparatus according to claim 8 wherein the stationary frame supports a first air powered device disposed to reciprocate the first reciprocatable cleaning member and a second air powered device disposed to reciprocate the second reciprocatable cleaning member.

10. Apparatus according to claim 9 wherein the first air powered device and the second air powered device comprise hollow members.

11. Apparatus according to claim 1 including a coating device adjacent the rotatable frame and disposed to apply a coating to the web after the web emerges from between the first contact cleaning roll and the second contact cleaning roll.

12. Apparatus according to claim 11 wherein the rotatable frame, contact cleaning rolls and coating device are enclosed in an explosion proof enclosure.

* * * * *